United States Patent [19]

Hubbard et al.

[11] Patent Number: 4,869,850

[45] Date of Patent: Sep. 26, 1989

[54] ROTOR-TYPE CARBURETOR APPARATUS AND ASSOCIATED METHODS

[75] Inventors: Elbert M. Hubbard, Dallas, Tex.; Rudolf Diener, Zurich, Switzerland

[73] Assignee: Kwik Products International Corporation, Portland, Oreg.

[21] Appl. No.: 142,302

[22] Filed: Dec. 29, 1987

Related U.S. Application Data

[63] Continuation of Ser. No. 899,667, Aug. 22, 1986, abandoned, which is a continuation-in-part of Ser. No. 877,445, Jun. 30, 1986, Pat. No. 4,726,342.

[51] Int. Cl.[4] ..... F02M 29/02

[52] U.S. Cl. ..... 261/88; 261/44.9; 261/DIG. 57; 261/DIG. 61; 261/DIG. 21

[58] Field of Search ..... 261/88, 44.9, DIG. 57, 261/DIG. 61, 89, DIG. 21

[56] References Cited

U.S. PATENT DOCUMENTS

| | | | |
|---|---|---|---|
| Re. 89,060 | 12/1976 | Reddy | 123/32 |
| 791,801 | 6/1905 | Leinau . | |
| 957,976 | 5/1910 | Lucas . | |
| 1,061,995 | 5/1913 | Erickson . | |
| 1,092,079 | 3/1914 | Reeder . | |
| 1,106,258 | 8/1914 | Tucker et al. . | |
| 1,120,763 | 12/1914 | Thomas | 261/DIG. 61 |
| 1,153,077 | 9/1915 | Hippel . | |
| 1,174,529 | 3/1916 | Sykes | 261/DIG. 21 |
| 1,283,294 | 10/1918 | Porter . | |
| 1,303,761 | 5/1919 | Bouteille | 561/DIG. 61 |
| 1,360,445 | 11/1920 | Rollins | 261/44.9 |
| 1,439,573 | 12/1922 | Orem . | |
| 1,529,612 | 3/1925 | Assmus . | |
| 1,597,072 | 8/1926 | Henkle . | |
| 1,636,187 | 7/1927 | Kessel . | |
| 1,730,410 | 10/1929 | Dennison . | |
| 1,746,439 | 2/1930 | Murrer . | |
| 1,767,305 | 6/1930 | Musall . | |
| 2,119,922 | 6/1938 | Lutz | 261/84 |
| 2,188,189 | 1/1940 | Miller, Jr. | 261/89 |
| 2,197,647 | 4/1940 | Lorenzen | 110/104 |
| 2,211,552 | 8/1940 | Bernstein et al. | 261/89 |
| 2,223,836 | 12/1940 | Snyder | 261/88 |
| 2,665,892 | 1/1954 | Rumpler | 261/89 |
| 2,668,698 | 2/1954 | Rollins | 261/41 |
| 2,759,718 | 8/1956 | Gideon | 261/65 |
| 2,791,409 | 5/1957 | Lauder | 261/71 |
| 2,823,906 | 2/1958 | Gideon | 261/56 |
| 2,998,230 | 8/1961 | Perretti | 261/30 |
| 3,208,738 | 9/1965 | Johnson | 261/34.2 |
| 3,279,769 | 10/1966 | Zysk | 261/35 |
| 3,439,903 | 4/1969 | Tolnai | 261/44 |
| 3,548,792 | 12/1970 | Palmer et al. | 123/32 |

(List continued on next page.)

FOREIGN PATENT DOCUMENTS

| | | | |
|---|---|---|---|
| 749179 | 7/1933 | France . | |
| 606784 | 11/1978 | Switzerland | 261/88 |
| 191633 | 1/1923 | United Kingdom | 261/DIG. 56 |
| 827861 | 5/1955 | United Kingdom . | |

*Primary Examiner*—Tim Miles

*Attorney, Agent, or Firm*—Hubbard, Thurman, Turner & Tucker

[57] ABSTRACT

An improved rotor-type carburetor for use with an internal combustion engine is provided which, in one embodiment, is adjustable to selectively vary its constant fuel-air ratio by axially moving an internal body portion thereof relative to the turbine rotor assembly of the carburetor. Alternatively, the constant fuel-air ratio of the carburetor may be altered simply by replacing such internal body portion with a differently configured one. Undesirable fuel delivery from the turbine rotor to the engine during turbine spin-down is significantly diminished through the use of an internal fuel reservoir structure, formed within the carburetor body, which functions to capture and retain unneeded fuel discharged from the rotor during turbine spin-down periods. During turbine spin-up periods (e.g., when the engine is being started) the reservoir-retained fuel is released into the engine's incoming air stream to hasten fuel delivery to the engiune during initial portions of turbine spin-up periods. Additionally, various structural improvements are incorporated into the carburetor. Included in these improvements are a carburetor body construction in which three generally annular sections are telescopingly interengaged to form the outer body of the carburetor, and the provision of improved sealing structures to better inhibit fuel leakage from the turbine rotor assembly.

43 Claims, 4 Drawing Sheets

U.S. PATENT DOCUMENTS

| | | | |
|---|---|---|---|
| 3,661,126 | 5/1972 | Baxendale | 123/32 |
| 3,704,702 | 12/1972 | Aono | 123/179 |
| 3,829,071 | 8/1974 | Valbona et al. | 261/89 |
| 3,920,778 | 11/1975 | De Rugeris | 261/39 |
| 3,960,118 | 6/1976 | Konomi et al. | 123/32 |
| 3,991,144 | 11/1976 | Diener | 261/88 |
| 4,036,186 | 7/1977 | Hattori et al. | 123/32 |
| 4,044,081 | 8/1977 | Neidlich | 261/51 |
| 4,055,609 | 10/1977 | Phelps | 261/DIG. 57 |
| 4,057,604 | 11/1977 | Rollins | 261/88 |
| 4,106,453 | 8/1978 | Burley | 123/120 |
| 4,168,679 | 9/1979 | Ikeura et al. | 123/32 |
| 4,170,975 | 10/1979 | Wessel et al. | 123/139 |
| 4,187,264 | 2/1980 | Diener | 261/84 |
| 4,196,264 | 4/1980 | Troedsson et al. | 429/114 |
| 4,207,274 | 6/1980 | Phillips | 261/50 |
| 4,245,317 | 1/1981 | Marchak | 364/431 |
| 4,249,496 | 2/1981 | Shimazaki et al. | 123/438 |
| 4,274,141 | 6/1981 | Tukuda et al. | 364/431 |
| 4,283,358 | 8/1981 | Diener | 261/88 |
| 4,353,848 | 10/1982 | Carsten | 261/69 |
| 4,366,541 | 12/1982 | Mouri et al. | 364/431.05 |
| 4,368,705 | 1/1983 | Stevenson et al. | 123/357 |
| 4,369,149 | 1/1983 | Violett | 261/44 |
| 4,377,137 | 3/1983 | Amano et al. | 123/179 |
| 4,399,792 | 8/1983 | Otsuka et al. | 123/489 |
| 4,401,080 | 8/1983 | Otsuka et al. | 123/440 |
| 4,407,248 | 10/1983 | Takeuchi et al. | 123/439 |
| 4,411,234 | 10/1983 | Middleton | 123/485 |
| 4,413,601 | 11/1983 | Matsuoka et al. | 123/480 |
| 4,455,981 | 6/1984 | Suzuki et al. | 123/438 |
| 4,457,282 | 7/1984 | Muramatsu et al. | 123/486 |
| 4,463,731 | 8/1984 | Matsuoka | 123/492 |
| 4,474,712 | 10/1984 | Diener | 261/88 |
| 4,485,795 | 12/1984 | Lockard | 123/590 |
| 4,492,202 | 1/1985 | Muramatsu et al. | 123/478 |
| 4,495,921 | 1/1985 | Sawamoto | 123/438 |
| 4,495,927 | 1/1985 | Yamato | 123/491 |
| 4,496,286 | 1/1985 | Gagnon | 417/22 |
| 4,503,003 | 3/1985 | Gilbert | 261/51 |
| 4,512,319 | 4/1985 | Williams et al. | 123/492 |
| 4,522,766 | 6/1985 | Sunada | 261/91 |
| 4,543,937 | 10/1985 | Amano et al. | 123/491 |
| 4,546,748 | 10/1985 | Karino et al. | 123/494 |

ROTOR-TYPE CARBURETOR APPARATUS AND ASSOCIATED METHODS

CROSS-REFERENCE TO RELATED APPLICATIONS

This application is a continuation of U.S. application Ser. No. 899,667 filed Aug. 22, 1986, now abandoned, which was a continuation-in-part of U.S. application Ser. No. 877,445 filed June 30, 1986 and issued Feb. 23, 1988 as U.S. Pat. No. 4,726,342.

BACKGROUND OF THE INVENTION

The present invention relates generally to constant fuel-air ratio, rotor-type carburetors utilized in internal combustion engines, and more particularly provides an improved rotor-type carburetor having an adjustable fuel-air ratio, a mechanism for diminishing unwanted fuel discharge therefrom during periods of rotor spin-down, and for enhancing fuel delivery during initial rotor spin-up periods, as well as various other structural improvements.

The rotor-type carburetor, also referred to as a "central injection device", has been proposed, in various versions thereof, as a as a replacement for the conventional carburetor in a variety of internal combustion spark ignition engines because of its very advantageous provision of an essentially constant fuel-air ratio ($\lambda$) at all operating speeds of the engine. In its basic operating format, the rotor-type carburetor is provided with a bladed turbine rotor section which is coaxially and rotationally disposed in the air intake passage of the engine upstream of the butterfly damper therein. During operation of the engine, ambient air drawn inwardly through the engine's air intake passage causes rapid rotation of the bladed rotor section. A centrifugal pumping mechanism formed within the rotor draws fuel from a source thereof into the rotor and forces the received fuel outwardly there through, via at least one lateral fuel discharge bore, onto and across a coaxial atomization or spray into the ingested air stream. Importantly, the quantity of finely atomized fuel entering the air stream is in an essentially constant ratio to the ingested quantity of air, thereby essentially eliminating the fuel-air ratio variation problems commonly encountered in conventional carburetors.

While previously proposed rotor-type carburetors have proven to be quite effective in providing this very desirable constant fuel-air ratio benefit, it is now seen as desirable to improve various structural and operational aspects of this type of carburetor. For example, in previously proposed versions of rotor-type carburetors, a given carburetor can produce only one constant fuel-air ratio when installed in an engine. Stated otherwise, such carburetor's constant fuel air ratio is fixed.

Thus, installation of the carburetor in another engine requiring a different fuel-air ratio is precluded-a different rotor-type carburetor having a different fuel-air ratio must be fabricated and installed in the different engine. This additionally means, of course, that the constant fuel-air ratio of a given rotor-type carburetor cannot be "fine tuned" to precisely meet the exact fuel-air ratio optimally required by the engine in which it is installed.

From the foregoing, it can readily be seen that it would be quite desirable to provide a rotor-type carburetor whose constant fuel-air ratio may be selectively altered. This would afford such carburetor with the ability to be fine-tune to a particular engine in which is installed, and additionally enable the use of a particular carburetor in a variety of engines having different fuel-air ratio requirements.

Another limitation or disadvantage commonly associated with previous rotor-type carburetors is that during certain spin-down periods of their rotor, they unavoidably continue to deliver at least a very small quantity of fuel to the engine. This spin-down period may occur either when the engine is being slowed during normal operation thereof, or immediately after the engine has been shut off. This excess fuel delivery is, of course, neither necessary nor particularly desirable.

As previously mentioned, the ingested air-driven rotor section of this type of carburetor has formed therein a passageway system which defines a centrifugal pump mechanism that causes fuel to be drawn into the rotor section and discharged therefrom, via a discharge opening in the rotor section, for mixture with the engine's ingested airstream. It is important for fuel efficient operation of the carburetor that fuel outflow through the rotor section be limited to that flowing outwardly through such discharge opening. However, the typical rotor section is formed from a variety of pieces which collectively define the pump-forming internal passageway system. The junctures of these various pieces within the rotor body, of course, define a variety of potential fuel leakage paths leading from the interior of the rotor to its exterior. Accordingly, effective sealing means must be provided to block the leakage path defined by these various junctures.

While the fuel leakage sealing means utilized in previously proposed rotor structures have typically maintained the outward fuel leakage below acceptable limits, it is seen as desirable to afford the rotor assembly with even more effective sealing means.

Accordingly, it is an object of the present invention to provide an improved rotor-type carburetor, and associated methods, which provides the above-mentioned benefits and advantages, and eliminates or minimizes above-mentioned and other limitations commonly associated with previously proposed carburetors of this type.

SUMMARY OF THE INVENTION

In carrying out principles of the present invention, in accordance with a preferred embodiment thereof, an improved rotor-type carburetor is provided which has three generally annular sections that are slidably and telescopingly interengaged to form a hollow, generally annular carburetor body that circumscribes an axis and defines an axially extending air flow passage, one of the three sections defining an axially extending conically sloping inner surface of the passage. The body is provided with support means which carry a bladed turbine rotor for rotation within the air flow passage in response to air flow there through. An internal passageway system is formed within the turbine rotor and defines therein centrifugal pump means which functions to draw fuel from a source thereof and discharge a fine fuel mist in response to rotation of the turbine rotor.

The support means include an upper support memeber to which is secured a ball bearing that rotatably supports an upper end portion of the turbine rotor. An axial, circular bore is extended downwardly through this supported end portion into the rotor body, and communicates at its upper end with an annular internal passage within the upper support member. The ball bearing is interposed between this annular support member passage and the carburetor's air flow passage. A fuel supply tube extends downwardly into the central axial bore in the rotor body and defines therewith an axially extending, annular passage within the rotor body.

A metal ring is press-fitted onto the upper end of the rotor body and has an upper end portion which outwardly circumscribes a cylindrical lower end portion of the upper support member, defining therewith an annular gap having a very small width. This very small annular gap functions as a restriction to inhibit outflow of fuel into the aforementioned central annular passage via the ball bearing. Outward fuel leakage through the ball bearing is further impeded by means of an annular teflon seal which is press-fitted into an upper end portion of the central rotor bore, and slidingly engages the fuel tube extending thereinto, and a radially enlarged lower end portion of the fuel supply tube.

To substantially reduce undesirable fuel discharge from the turbine rotor during spin-down periods thereof, means are provided adjacent the discharge opening of the turbine rotor for capturing and storing fuel discharged from the turbine rotor during such periods of turbine spin-down. These fuel capturing and storing means additionally function to release the captured and stored fuel into the ingested air stream during periods of turbine spin-up to thereby provide for more rapid delivery of fuel to the ingested air stream during the initial phase of turbine spin-up.

According to a very important aspect of the present invention, in another embodiment thereof means are provided for selectively altering the effective cross-sectional area of the carburetor's air flow passage extending axially along the bladed portion of its turbine rotor to thereby selectively alter the carburetor's constant fuel-air ratio. In one version of this feature, one of the three carburetor body sections forms a portion of the air flow passage surface which outwardly circumscribes the rotor's turbine blades, and is axially movable relative to the turbine rotor. Means are provided for selectively axially moving this section to thereby alter the effective cross-sectional area of the air flow passage portion which circumscribes the turbine blades.

In another version of this unique fuel-area ratio altering feature, the carburetor body has a replaceable interior section which defines the air flow passage surface portion which circumscribes the rotor's turbine blades. To effect a change in the carburetor's constant fuel-air ratio, this surface-defining section of the carburetor body is simply replaced with an alternate annular interior section which has a slightly different interior surface configuration.

DETAILED DESCRIPTION

Figure 1:
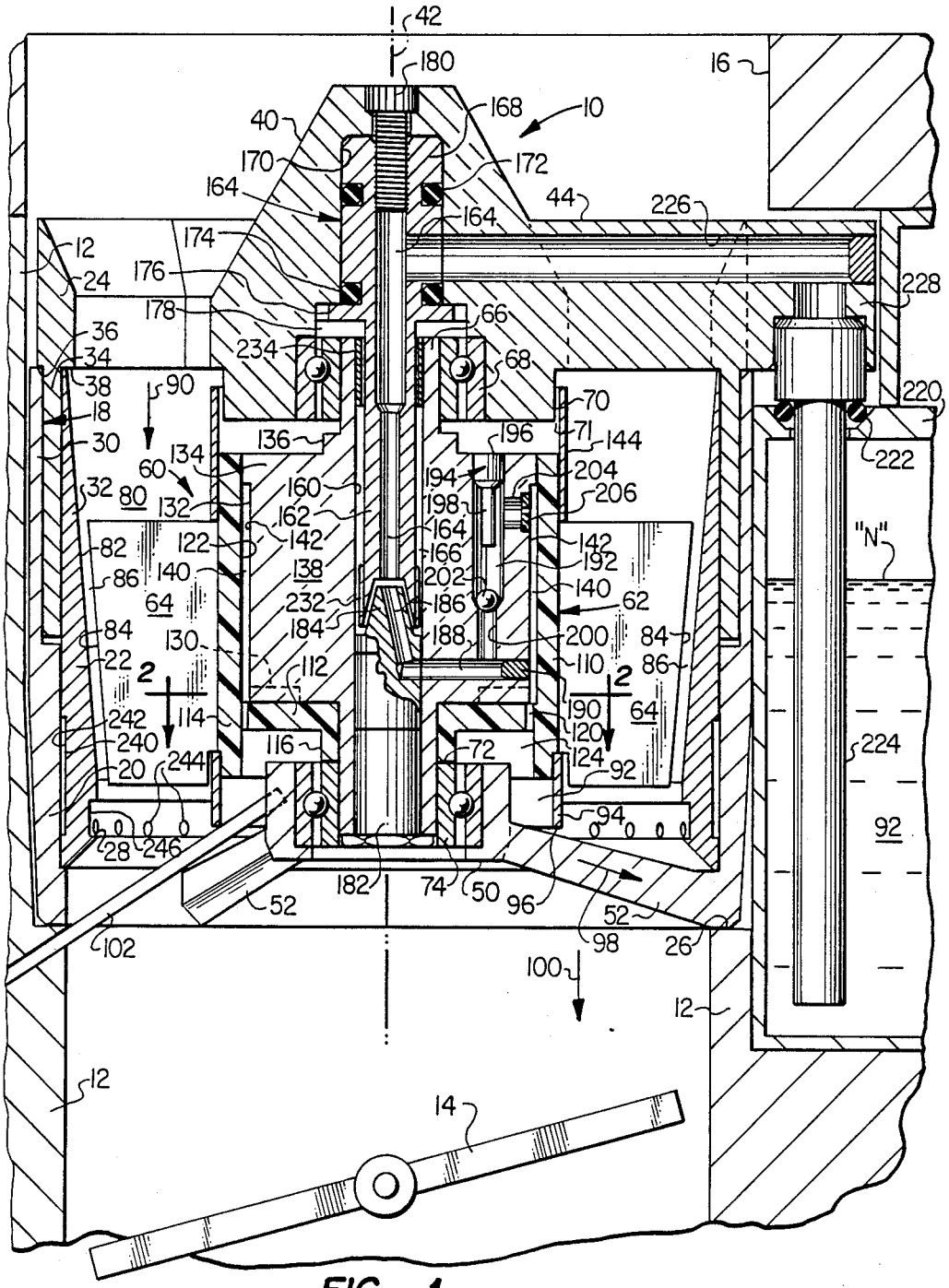
FIG. 1 is a cross-sectional view taken through an improved rotor-type carburetor which embodies principles of the present invention.
Figure 5:
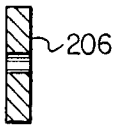
FIG. 5 is an enlarged cross-sectional view through a fuel discharge orifice positioned within the turbine rotor.
Figure 6:
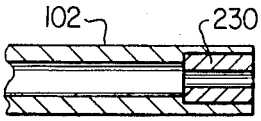
FIG. 6 is an enlarged cross-sectional view through a discharge end portion of a fuel injection tube extending into the carburetor.

Cross-sectionally illustrated in FIG. 1 is an improved rotor-type carburetor 10 which embodies principles of the present invention and is coaxially carried within an upper end portion of the air induction pipe 12 of an internal combustion engine (not shown), above the pipe's butterfly valve 14 and generally below the engine's air filter 16 at the top of the pipe. Carburetor 10 has an annular outer body 18 which is comprised of three telescopingly and slidably interengaged sections-an annular lower section 20, an annular inner section 22, and an annular upper section 24.

The lower section 20 rests upon an annular, upwardly facing ledge 26 formed in the pipe 12, and internally receives the inner section 22, the lower end of section 22 being supported by an annular, upwardly facing internal ledge 28 formed in section 20. Upper end portions 30, 32 of sections 20, 22 define in the body 18 an annular channel which slidably receives a lower end portion 34 of the upper section 24. Upper section 24 has formed thereon an annular, downwardly facing external ledge 36 which rests upon the upper end of the lower section 20, and further has an annular, downwardly facing internal ledge 38 which, with the ledge 28, captively retains the inner section 22 within the carburetor body 18.

A generally frustroconically shaped upper support member 40, which is coaxial with the axis 42 of the carburetor 10 and induction pipe 12, is carried at the upper end body section 24 by means of three radially extending support arms 44, 46, 48 (FIG. 3) formed in the upper section 24, arm 44 being cross-sectionally larger than the support arms 46 and 48. Coaxially positioned inwardly of the lower end of the carburetor body 18 is a generally annular lower support member 50 which is carried by three generally radially extending support arms 52 (only two of which are illustrated) that extend inwardly from the lower end of body section 20.

Coaxially disposed within the carburetor body 18 for rotation about axis 42 is a turbine rotor assembly 60 having a cylindrical rotor body 62 from which a circumferentially spaced series of turbine blades 64 radially outwardly project. The rotor body 62 has a central upper end boss 66 which is received in the inner race portion of a ball bearing 68 that is press-fitted into an annular lower end portion 70 of the upper support member 40. Similarly, the rotor body 62 has a lower end central support boss 72 which is received within the inner race portion of a ball bearing 74 that is press-fitted into the annular lower support member 50.

The upper support member 50 and the rotor body 62 define with the carburetor body 18 an annular air flow passage 80 which extends axially through the carburetor 10 and downwardly across the turbine blades 64. It can be seen in FIG. 1 that the inner surface 82 of carburetor body section 22 is conically inwardly sloped in a downward direction, thereby defining a similarly sloped portion of the air flow passage 80 that extends axially along the bladed portion of the turbine rotor assembly 60. The radially outer ends 84 of blades 64 are similarly sloped, and positioned slightly inwardly of interior surface 82, thereby defining small, axially extending gaps 86 between each of the blade ends 84 and the interior surface 82.

During operation of the engine, ambient air 90 is ingested downwardly through the annular passage 80 and flowed across the turbine blade 64, thereby causing rapid rotation of the turbine rotor assembly 60. In a manner subsequently described in more detail, there is formed within the rotor body 62 an internal passageway system which defines the centrifugal pump means that function in response to rotation of the turbine rotor 60 to draw fuel 92 into the rotor body 62. The received fuel is forced downwardly into an annular fuel discharge passage 92 defined between the lower support member 50 and a metal spray ring 94 which is press-fitted onto the lower end of rotor body 62 and has a sharply squared annular lower end surface 96. The fuel then exists the discharge passage 92 across the lower ring edge 96 which converts the fuel into a fine fuel mist or "fog" 98 which mixes with the ingested air stream 90 to form a fuel-air mixture 100 which is delivered to the engine.

Importantly, the carburetor 10 advantageously functions to maintain the fuel-air ratio of the mixture 100 at an essentially constant level for all engine speeds. To selectively fuel-enrich the mixture 100, during certain engine operating conditions, an automatic fuel injection system (not shown) is provided to periodically inject fuel into the annular discharge passage 92, via a small fuel injection tube 102 extending into passage 92, in response to sensed variations in selected engine operating parameters.

Further details of the structure and operation of such fuel injection system, together with further details relating to the operation of rotor-type carburetors, may be found in U.S. Pat. application Ser. No. 877,445, Filed on June 30, 1986, and entitled: "Fuel-Air Ratio (λ) Correcting Apparatus For a Rotor-Type Carburetor For Internal Combustion Engines". Such application, of which the present application is a continuation-in-part, is hereby incorporated by reference herein.

Figures 2, 3, 4:
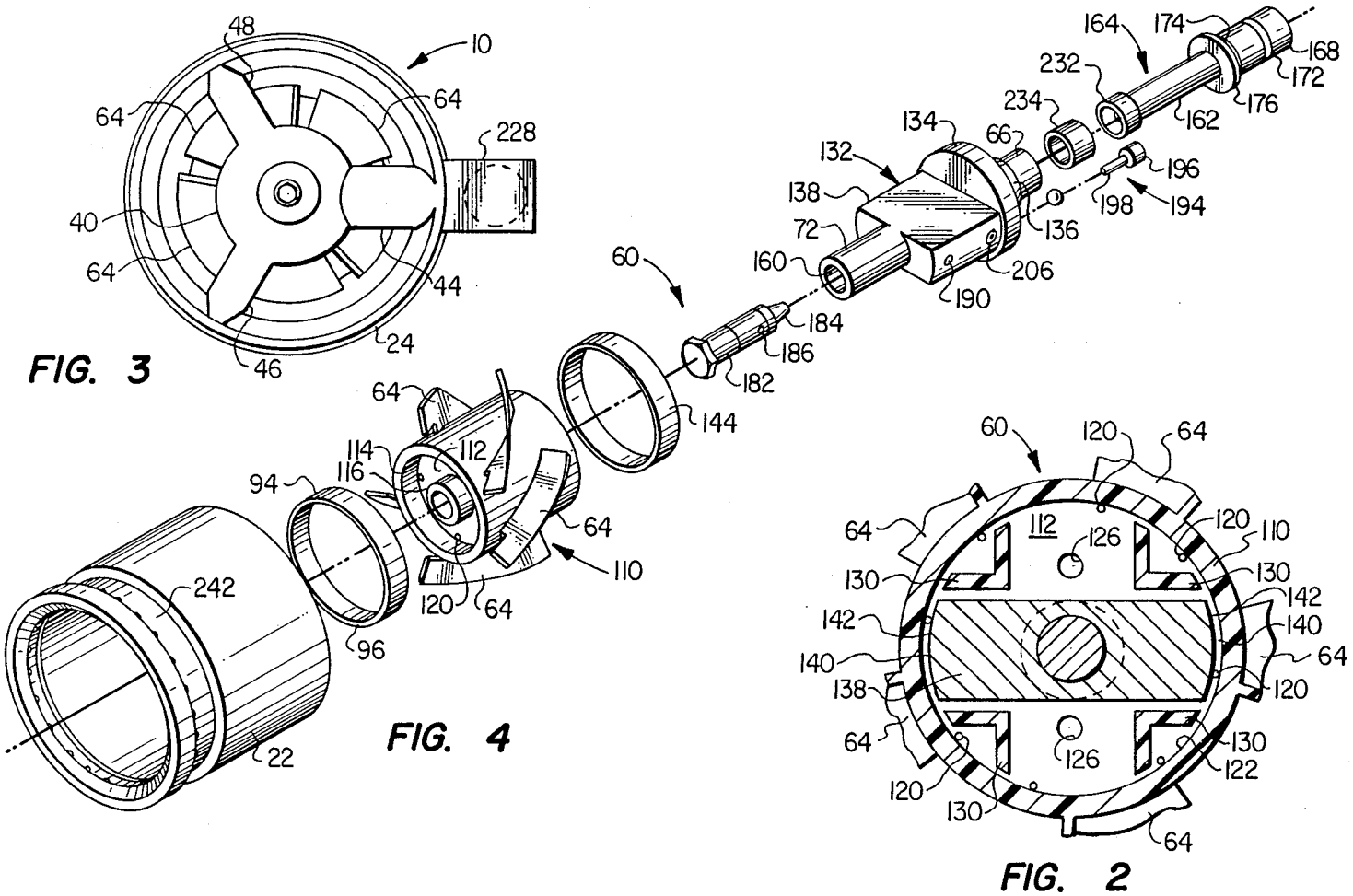
FIG. 2 is a cross-sectional view taken through the carburetor along line 2—2 of FIG. 1.
FIG. 3 is a reduced scale top plan view of the carburetor.
FIG. 4 is an exploded perspective view of an axially central portion of the carburetor including its turbine rotor assembly.

Referring now to FIGS. 1, 2 and 4, the construction of the turbine rotor assembly 60 will be described in detail. The rotor body 62 includes a hollow, generally cylindrical injection molded plastic outer shell 110 which has the turbine blades 64 molded integrally therewith. The upper end of shell 110 is open, while the lower end of the shell is closed by an axially recessed annular closure portion 112 which defines at the lower end of shell 110 a downwardly extending annular skirt 114. An inner peripheral section of closure portion 112 is turned downwardly to define an annular skirt 116. In the position of the rotor body 62 illustrated in FIG. 1, the lower end of skirt 116 engages the inner race of the lower bearing 74.

A circumferentially spaced array of small fuel discharge openings 120 are formed axially through the closure portion 112, adjacent the interior surface 122 of shell 110, and intercommunicate the shell interior with an annular channel 124 defined by the shell skirt 114. As may best be seen in FIG. 2, a pair of slightly larger vent openings 126 are formed through the lower closure portion 112 and are positioned radially inwardly of the small openings 120. Vent openings 126 function to vent the interior of shell 110, thereby creating a siphon-breaking action therein to prevent fuel from being siphoned out the openings 120 after engine shutdown. Extending upwardly from the closure portion 112 within the shell 110 are two diametrically opposed pairs of guide members 130 each having a generally L-shaped cross-section.

The rotor body 62 also includes a metal inner member 132 which extends into and through the interior of shell 110. Member 132 has cylidrical upper and lower end portions which respectively define the upper and lower support bosses 66, 72 of the turbine rotor assembly 60. Support boss 66 extends upwardly from an annular flange 134, and is cylindrically enlarged at its juncture with such flange to form an annular shoulder 136. Flange 134 is press-fitted into the open upper end of shell 110, and has thereon a downwardly extending, rectangularly cross-sectioned portion 138 which bears at it lower end against the upper surface of the shell closure portion 112. The support boss 72 extends downwardly from the lower end of portion 138.

Radially opposite lower end portions of element 138 are received between the opposite pairs of guide members 130 as best illustrated in FIG. 2, the vent openings 126 being positioned on opposite sides of such rectangular portion 138. As can be seen in FIGS. 1 and 2, the major lateral dimension of inner member portion 138 is slightly smaller than the diameter of flange 134 so that small, axially extending gaps 140 are defined between the narrow side surfaces 142 of portion 138 and the interior shell surface 122.

As best illustrated in FIG. 1, an upper end portion of the spray ring 94 is press-fitted into an annular notch formed around a lower end portion of the shell skirt 114. Additionally, a metal ring 144 has a lower end portion thereof press-fitted onto an upper end portion of the shell. Ring 144 has an internal diameter just slightly larger than the external diameter of annular support member portion 70 and projects upwardly beyond the lower end of portion 70, outwardly circumscribing portion 70 defining therewith an annular gap 71 which has a very small width (on the order of one millimeter).

The internal passageway system, formed within the rotor body 62 and defining therein centrifugal pump means, will now be described. A circular axial bore 160 extends centrally through the inner rotor body member 132 from the upper end of support boss 66 to the lower end of support boss 72. A lower end portion 162 of a fuel supply tube 164 having a central flow passage 164 extends downwardly into bore 160, defining therein a vertically extending annular passage 166. An upper end portion 168 of tube 164 is cylindrically enlarged and is received in a vertically extending opening 170 formed in the upper support member 40. This upper end portion 168 is sealed within the opening 170 by means of a pair of axially spaced O rings 172, 174. Formed at the base of the enlarged tube portion 168 is an annular flange 176 which engages the upper end of a larger diameter circular opening 178 extending upwardly into the support member 40. The upper end of the internal tube passage 164 is closed by a threaded closure member 180 screwed into the top of the enlarged fuel tube portion 168.

A lower end portion of the central bore 160 is blocked by a cylindrical closure member 182 which has a conically-shaped upper end portion 184 and is press-fitted upwardly into the lower end of bore 160. The conical upper end portion 184 is received in a complementarily formed conical recess in the lower end of tube portion 162. Extending inwardly through the upper end of conical portion 184 is an axially canted passage 186 which faces the tube passage 164 and, at its lower end, turns radially outwardly through the side surface of the closure member 182. At its lower end, passage 186 communicates with a horizontally extending passage 188 formed in the inner rotor body member rectangular portion 138, the passage 188 being closed at its outer end by a plug member 190.

The horizontal passage 188 communicates with a vertical passage 192 which extends downwardly through the upper flange 134 and is closed at its upper end by a cylindrical plug member 194 having an upper end portion press-fitted into the passage 192, and a lower end portion 198 which is of a lesser diameter than that of the passage 192. The diameter of a lower end portion 200 of the vertical passage 192 is reduced to form an annular shoulder upon which a ball 202 rests. Ball 202 forms within passage 192 a check valve which precludes the downward passage of fuel through passage 192, the lower end of closure member portion 198 serving to limit the upward travel of the ball.

Finally, just below the flange 134 within the rectangular rotor body portion 138 there is formed a horizontal passage 204 which extends from the vertical passage 192 outwardly through the right (as viewed in FIG. 1) laterally facing narrow surface 142 of the rotor body portion 138. Cemented into the outer end of this passage 204 is a small fuel discharge orifice member 206.

The previously mentioned fuel 92 is contained within a reservoir housing 220 positioned adjacent the air induction pipe 12. The upper level "N" of the fuel is float-maintained (in a conventional matter not herein discussed) at a height somewhat below that of the orifice 206. Extending downwardly through the housing 220 into the fuel 92, and sealed by means of an O ring 222, is a fuel inlet tube 224. At its upper end the inlet tube 224 communicates with a horizontal fuel passage 226 which extends laterally outwardly from the vertically extending fuel supply tube passage 164 through the upper support member 40, the support arm 44, and into a generally block-shaped member 228 which generally defines an outward extension of the support arm 44.

During operation of the carburetor 10, the ingested air-driven turbine rotor assembly, via its internal centrifugal pump means, draws fuel 92 upwardly through the inlet pipe 24, and into the supply tube passage 164 via the horizontal passage 226. Fuel entering the supply tube passage 164 is drawn downwardly therethrough, into the axially canted passage 186 and then centrifugally forced outwardly through the horizontal passage 188. The fuel is then forced upwardly through the vertical passage portion 200 (thereby lifting the ball 202 off its seat), travels upwardly through the passage 192, goes around the reduced diameter plug member portion 198 and is laterally discharged from the orifice 206 via a short horizontal passage 204.

Fuel discharged from the orifice 206 flows downwardly along the annular interior shell surface 122 and is forced downwardly through the small fuel discharge openings 120 into the annular discharge passage 92 via the annular skirt channel 124. Fuel entering the annular discharge passage 92 is forced outwardly across the sharply squared lower end 96 of the spray ring 94 to thereby form the fine fuel mist 98 which is mixed with the ingested air flow stream 90.

In addition to the unique structure of the carburetor 10 just described, the present invention also provides the carburetor with several other novel structural improvements which increase its operating efficiency and effectiveness.

For example, in developing the carburetor 10, it was found that the dimensional precision of the discharge opening in the orifice member 206, and the orifice member 230 positioned in the discharge end of fuel injection tube 102, was of vital importance in maintaining the desired fuel delivery precision of the carburetor. To further enhance this precision, the orifice members 206, 230 in carburetor 10 are formed from a synthetic jewel material, preferably a synthetic ruby material.

Additionally, substantially improved sealing mechanisms have been provided to even further impede undesirable outward fuel leakage from the turbine rotor assembly 60 across the junctures of its various components and supporting means.

An example of this improved sealing effectiveness is the use of the upper ring 144 (FIG. 1) to impede outward fuel leakage from the bearing 68 via upward fuel travel through the vertical annular passage 166. In developing the carburetor 10 it was found that under certain engine operating conditions a slight vacuum was created in the air passage 80 adjacent the lower end portion 70 of upper support member 40 which tended to draw fuel outwardly through the upper bearing 68. It was also found that the very small annular gap 71 formed between ring 144 and the support member portion 70 markedly inhibited such undesirable fuel outflow. While the exact mechanism of such fuel outflow inhibition is not known, it is theorized that the annular gap 71 creates a restrictive passageway interposed between air passage 80 and bearing 68, and further creates a small area of turbulence adjacent the upper end of ring 144, to impede such fuel outflow.

To further impede outward fuel leakage from the bearing 68 via upward fuel travel through the vertical annular passage 166, a lower end portion 232 of the fuel supply tube portion 162 is radially enlarged (to a diameter just slightly smaller than that of the central bore 160) to inhibit upward fuel flow in the bore 160 from adjacent the juncture of the fuel tube and the upper end portion 184 of the lower closure member 182. Upward fuel leakage from the circular bore 160 is even further inhibited by the use of an annular teflon seal element 234 which is press-fitted into the upper end of bore 160 and slidably receives the fuel supply tube, thereby forming a wiping seal thereon.

The carburetor 10 is also uniquely provided with means for substantially diminishing undesirable fuel discharge therefrom during periods of rotor spin-down. Such spin-down periods may occur during normal deceleration of the engine (with the butterfly damper 14 closed) or upon engine shutdown.

Referring now to FIGS. 1 and 4, this very desirable feature is incorporated in the present invention by means of a small annular fuel reservoir chamber 240 defined in the carburetor body 18 by an annular external groove 242 formed in the radially outer surface of the inner body section 22 adjacent its lower end. The reservoir chamber 240 communicates with the interior of the carburetor body via a circumferentially spaced series of small capillary openings 244 which extend radially inwardly through a circumferential groove 246 formed in the inner surface of the inner section 22 and positioned axially adjacent a lower end portion of the reservoir chamber 240. As can be seen in FIG. 1, the chamber 240, the capillary openings 244, and the internal surface groove 246 all circumscribe the atomization or spray ring 94, with the openings 244 extending just slightly below the lower end 96 of the ring 94.

During spin-down periods of the rotor, at least a small quantity of fuel is flowing outwardly from the annular discharge passage 92 due to the continuing centrifugal pumping action of the still-spinning rotor. In the present invention, this exiting fuel impinges upon the radially inwardly facing surface of the interior groove 246 and is flowed radially outwardly into the reservoir chamber 240 via the capillary openings 244. Thus, instead of being undesirably discharged from the carburetor 10, such exiting fuel is captured and stored within the reservoir chamber 240 during turbine spin-down.

Fuel captured in the reservoir chamber 240 is retained therein until the carburetor 10 experiences a period of rotor spin-up (for example, when the engine is accelerated again, or is initially started). During an initial period of such rotor spin-up, while the rotor's centrifugal fuel-pumping action is being built up again, the retained fuel within the reservoir 240 is automatically utilized as an initial fuel supply to the engine. Specifically, when the rotor begins its spin-up, the retained fuel automatically exits the reservoir chamber 240 via the capillary openings 244 to thereby provide a substantially instantaneous fuel supply to the engine during the initial period of rotor spin-up.

Figure 7:
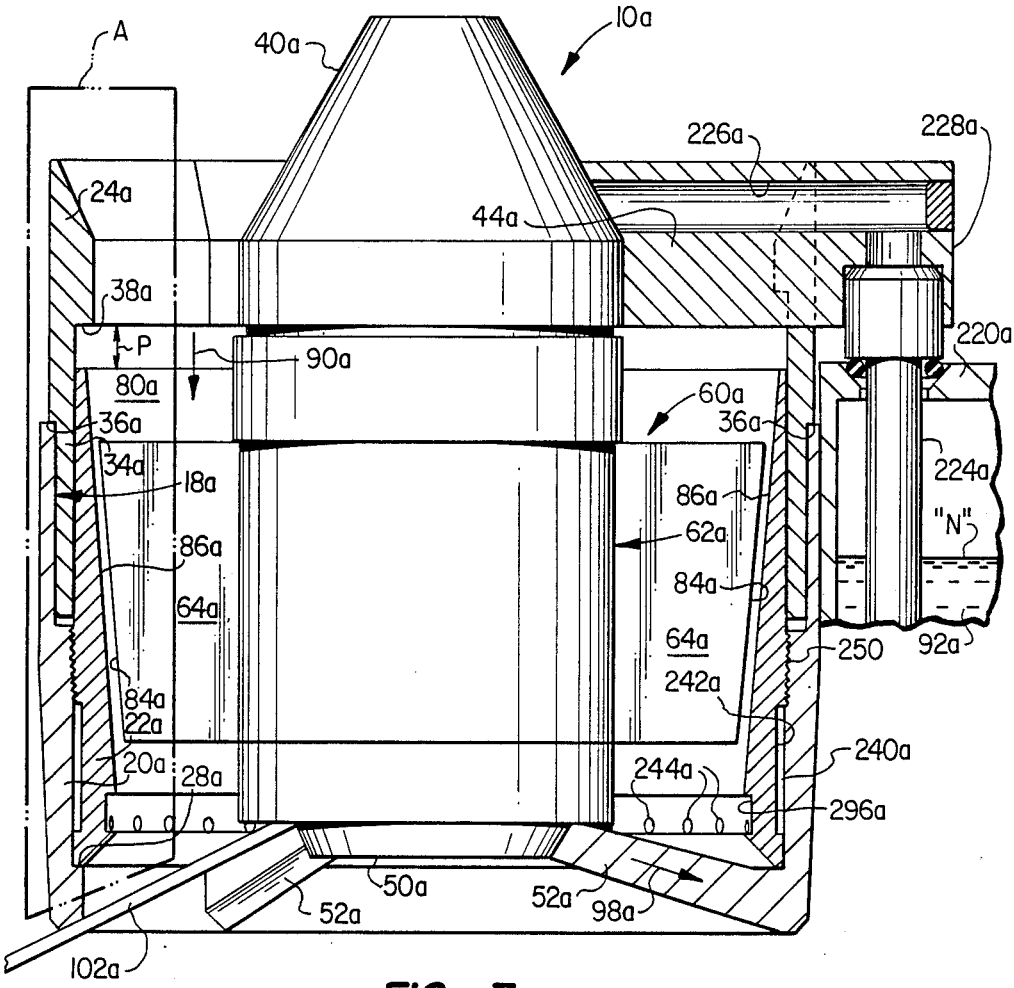
FIG. 7 is a simplified cross-sectional view, partially in section and partially in elevation, through an alternate embodiment of the carburetor and illustrates an alternate construction of the carburetor's body which permits the carburetor's constant fuel-air ratio to be selectively altered.

Illustrated in simplified form in FIG. 7 is an alternate embodiment $\mathbf{10}_a$ of the carburetor 10 in which means are provided for selectively altering its constant fuel-air ratio. With the important exceptions subsequently noted, the structure of the carburetor $\mathbf{10}_a$ is similar to that of the previously described carburetor 10, the reference numerals of similar parts in carburetor $\mathbf{10}_a$ being given the subscript "$_a$".

While the present invention provides several versions of these fuel-air ratio altering means, a central theme thereof is that for a given mass of ingested air $\mathbf{90}_a$ downwardly traversing the turbine blades $\mathbf{64}_a$, the velocity of such traversing air is selectively increased. This velocity increase of the same air quantity increases the rotational speed of the turbine rotor $\mathbf{60}_a$ to thereby increase the volume of fuel provided for mixture with the air. This increased fuel quantity delivered to the fixed quantity of air $\mathbf{90}_a$ causes the fuel-air mixture to be fuel-enriched. (Conversely, a decrease in the blade traversal velocity of a given quantity of ingested air $\mathbf{90}_a$ will slow the rotational velocity of the turbine rotor, thereby creating a leaner fuel-air mixture).

To effect this selective air velocity alteration in the present invention, several methods are provided for selectively varying the width of the gaps $\mathbf{86}_a$ positioned between the radially outer blade ends $\mathbf{84}_a$ and the conically tapered inner surface $\mathbf{82}_a$ of the inner carburetor body section $\mathbf{22}_a$. It can be seen that these gaps $\mathbf{86}_a$ define "bypass" portion of the air flow passage $\mathbf{80}_a$ around the turbine blades $\mathbf{64}_a$. The bypass portions reduce the "effective" cross-sectional area of the air flow passage $\mathbf{80}_a$ ("effective cross-sectional area", as used herein, meaning that portion of the total available flow area through which air flow actually impacts the turbine blades). It can thus be seen that by varying the widths of the gaps $\mathbf{86}_a$, the effective cross-sectional area of the flow passage $\mathbf{80}_a$, and thus the rotational velocity of the turbine rotor, may also be selectively varied.

According to the present invention, the width of gaps $\mathbf{86}_a$ may be selectively narrowed or widened by replacing the inner body section $\mathbf{22}_a$ with an alternate inner section (not shown) which has a thicker or thinner conically tapered wall portion, a thicker wall portion narrowing the gaps $\mathbf{86}_a$ and increasing the rotor's rotational speed, and a thinner wall portion widening the gaps $\mathbf{86}_a$ to thereby decrease its rotational speed.

In the alternate carburetor embodiment $\mathbf{10}_a$ depicted in FIG. 7 (in which the reference numerals of components similar to those in FIG. 1 have been given the subscript "a"), the fuel-air ratio altering aspect of the present invention is carried out by selectively moving the inner body section $\mathbf{22}_a$ in an axial direction relative to the balance of the carburetor. To permit this axial movement of the body section $\mathbf{22}_a$ relative to the rest of the carburetor, the body $\mathbf{18}_a$ is configured slightly differently than its counterpart body 18 in FIG. 1. Specifically, the body sections $\mathbf{20}_a$, $\mathbf{22}_a$ are made shorter than their counterparts 20, 22 in FIG. 1, and the shoulder $\mathbf{36}_a$ is lowered accordingly. This alteration permits the inner body section $\mathbf{22}_a$ to be moved upwardly and downwardly through an axial play distance "P" between the upper ledge $\mathbf{38}_a$ and the lower ledge $\mathbf{28}_a$.

Moreover, in the carburetor $\mathbf{10}_a$, the inner body section $\mathbf{22}_a$ is threaded into the lower body section $\mathbf{20}_a$ by means of interengaged threaded portions thereon positioned directly above the reservoir chamber $\mathbf{240}_a$ and indicated by the reference numeral 250. To axially adjust the inner body section $\mathbf{22}_a$ the upper body section $\mathbf{24}_a$ is simply removed and the inner body section $\mathbf{22}_a$ manually rotated relative to the lower body section $\mathbf{20}_a$. To facilitate this manual rotation, an upper end portion of section $\mathbf{20}_a$ extends upwardly beyond the upper end of section $\mathbf{20}_a$, (when the inner body section $\mathbf{22}_a$ is bottomed out against lower ledge $\mathbf{28}_a$ as indicated in FIG. 7), thereby making the inner section easier to grasp from above to rotate it.

It can be seen in FIG. 7 that by rotating the inner section $\mathbf{22}_a$ to cause its upward movement would draw the interior surface $\mathbf{82}_a$ closer to the blade ends $\mathbf{84}_a$, thereby narrowing the gaps $\mathbf{86}_a$ and creating a slightly richer fuel-air ratio, while moving the inner section downwardly would widen the gaps $\mathbf{86}_a$, thereby creating a leaner fuel-air ratio. It should be noted that to assure that at least a portion of the sloping interior surface $\mathbf{82}_a$ is always positioned axially beneath the turbine blade $\mathbf{64}_a$, the blades are moved slightly upwardly along the rotor body $\mathbf{62}_a$ relative to the axial blade positioning depicted in FIG. 1.

Figure 8:
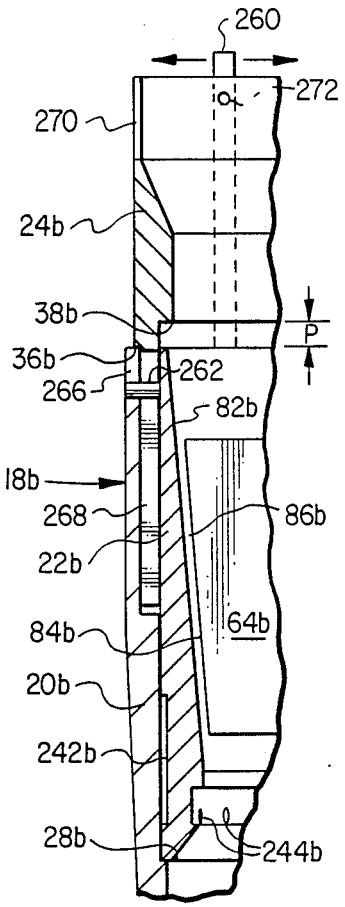
FIG. 8 depicts an alternate construction of the carburetor wall section positioned within the dashed area "A" of FIG. 7.
Figure 9:
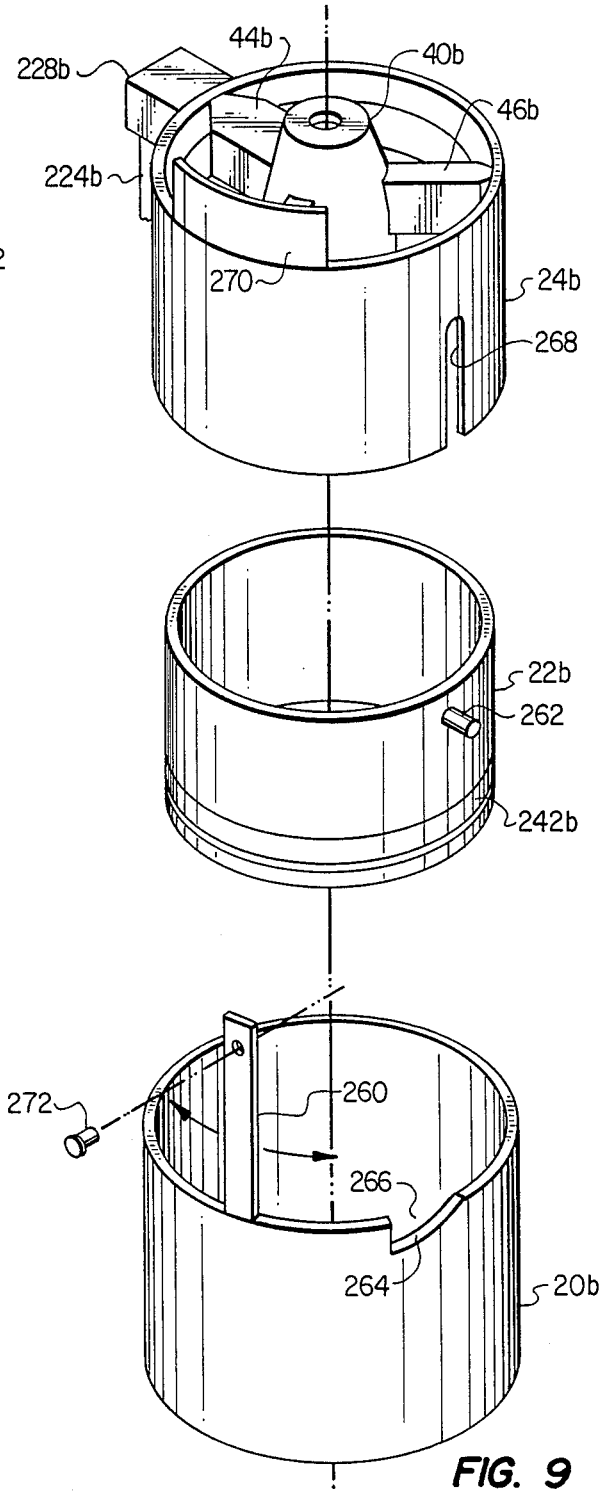
FIG. 9 is a simplified, exploded perspective view of the carburetor body and further illustrates the modified body wall construction cross-sectionally depicted in FIG. 8.

Illustrated in FIGS. 8 and 9 is another embodiment $\mathbf{18}_b$ of the carburetor body 18 which also permits axial movement of the inner carburetor body section to thereby selectively alter the constant fuel-air ratio of the carburetor. In FIGS. 8 and 9 the reference numerals of components similar to those illustrated in FIG. 7 have been given the subscript "$_b$". In the modified body 18$_b$ the threaded portion 250 which, in carburetor 10$_a$, intersecures the lower and inner body sections is eliminated, thereby permitting the inner body section 22$_b$ to rotate relative to the balance of the carburetor body. As will be seen, such relative rotation of intersection 22$_b$ causes it to move axially of the body to thereby selectively adjust width of the blade gaps 86$_b$.

To facilitate manual rotational adjustment of the inner body section 22$_b$, an elongated adjusting tab is secured at its lower end to the upper end of the lower carburetor body section 20$_b$. A small pin 262 is secured to inner body section 22$_b$ and projects radially outwardly therefrom adjacent its upper end. Pin 262 rests upon the upwardly facing surface 264 of an axially ramped notch 266 formed in the upper end of lower body section 20$_b$. The pin extends radially through an elongated retaining notch 268 formed in the upper body section 24$_b$ and extending upwardly from its lower end. The upper body section 24$_b$ is also provided with a holding tab 270 which is secured to and projects upwardly from its upper end around a circumferential portion thereof, the tab 270 being wider than the adjusting tab 260.

To adjust the axial position of the inner body section 22$_b$, an upper end portion of the adjusting tab 260 (which, as illustrated in FIG. 8, projects upwardly beyond the holding tab 270) is simply grasped and pushed in a selected circumferential direction, as indicated by the directional arrows in FIGS. 8 and 9, to rotate the lower body section 20$_b$ in a selected direction. Depending on its direction, the rotation of the ramped surface 264 causes upward or downward motion of the pin 262 within slot 268 (which is rotationally locked by virtue of the connection of fuel inlet tube 224$_b$ to the fuel reservoir housing), and thus the upward or downward movement of inner body section 22$_b$. Inner body section 22$_b$ may be locked in a desired axial position thereof by means of a set screw 272 which is used to secure the adjusting tab 260 in a desired position along the holding tab 270.

The use of the adjusting tab 260 to selectively vary the axial position of inner body section 22$_a$ conveniently provides a method of manually altering the carburetor's constant fuel-air ratio while the engine is running, the upper end of the adjusting tab being readily accessible simply by removing the engine's air filter.

Figure 10:
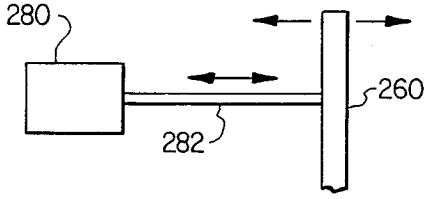
FIG. 10 is a simplified schematic diagram illustrating a control system utilized to automatically vary the fuel-air ratio of the carburetor.

However, if desired, automatic movement of the adjusting tab 260 could be achieved by, for example, an automatic control system 280 (FIG. 10) which senses variations in selected engine operating parameters and responsively moves the adjusting tab 260, as just described, via a suitable actuating rod 282. When this automatic adjustment method is employed, the fuel injection tube 102 (and its associated fuel injection system) may be eliminated.

It can be seen from the foregoing that the present invention uniquely provides a rotor-type carburetor whose constant fuel-air ratio may be quickly and easily altered to thereby advantageously provide the carburetor with the ability to be "fine tuned" to a particular engine in which it is installed, or to be installed in a variety of engines having different fuel-air ratio requirements. Further, the carburetor is provided with a unique mechanism which automatically reduces undesirable fuel flow to the engine during rotor spin-down periods, while at the same time providing for more rapid fuel delivery to the engine during rotor spin-up periods. Moreover, the carburetor apparatus described above has incorporated therein a variety of very desirable structural improvements which enhance its internal sealing capabilities and the precision of its fuel delivery.

The foregoing detailed description is to be clearly understood as given by way of illustration and example only, the spirit and scope of this invention being limited solely by the appended claims.

What is claimed is:

1. In a rotor-type carburetor adapted to provide to an internal combustion engine an air-fuel mixture having an essentially constant fuel-air ratio at all engine speeds, said carburetor having an annular body which has an axis and whose inner surface defines an air flow passage, said carburetor further having a bladed turbine rotor disposed in said air flow passage for rotation about said axis, apparatus for selectively altering said fuel-air ratio, said apparatus comprising means for selectively altering the effective cross-sectional area of said air flow passage extending axially along the bladed portion of said turbine rotor;

said body including a first member defining a portion of the inner surface of said air flow passage adjacent said blades and being rotatable relative to the balance of said body;

said area-altering means including means for selectively axially moving said first member relative to said turbine rotor, said means for selectively axially moving said first member functioning in response to relative rotation between said first member and the balance of said body and including a radially projecting pin secured thereto, and an axially ramped surface formed in the balance of said body and operatively engaging said pin;

said balance of said body including second and third members circumscribing said first member and being rotatable about said axis relative to one another;

said ramped surface being formed in said second member;

said second member having an adjusting member secured thereto, and being configured and positioned to facilitate manual movement thereof to cause rotation of said second member about said axis;

said third member being adapted to be secured against rotation about said axis, and having a holding member secured thereto and positioned adjacent said adjusting member;

said third member having a pair of facing surfaces positioned to prevent appreciable circumferential movement of said pin; and said apparatus further comprising means for selectively preventing relative movement between said adjusting member and said holding member.

2. Constant fuel-air ratio rotor-type carburetor apparatus comprising:

(a) a plurality of generally annular sections slidably and telescopingly interengaged, and forming a hollow, generally annular body circumscribing an axis and defining an axially extending air flow passage, one of said sections defining an axially extending, conically sloping inner surface of said passage;

(b) support means carried by said body;

(c) a bladed turbine rotor carried by said support means for rotation within said air flow passage in response to air flow therethrough; and (d) passageway means formed in said turbine rotor for defining a centrifugal pump for drawing fuel from a source thereof and discharging a fine fuel mist in response to rotation of said turbine rotor.

3. The apparatus of claim 2 wherein said conically sloped inner surface is positioned circumferentially adjacent the blades of said turbine rotor.

4. The apparatus of claim 2 wherein said plurality of generally annular sections include:

(1) a lower section having an upper end portion, (2) an inner section having a lower end portion slidably received within and supported by said lower section, and having an upper end portion defining an annular slot with said upper end portion of said lower section, said inner section defining said conically sloped inner surface of said air flow passage, and (3) an upper section having a lower end portion slidably received in said annular slot.

5. The apparatus of claim 2 wherein said turbine rotor has a generally cylindrical, hollow body section having an axially extending interior side surface adapted to receive and axially transfer a flow of fuel drawn into said hollow rotor body section during operation of said carburetor apparatus, said turbine rotor further having a lower end member closing a lower end portion of said hollow rotor body section, said lower end member having a mutually spaced circumferential array of small fuel discharge openings formed therethrough and positioned adjacent said interior side surface, said array being coaxial with said hollow body section, said lower end member further having a plurality of vent openings formed therethrough radially inwardly of said fuel discharge openings to vent the interior of said hollow rotor body section, thereby providing a syphon-breaking action therein.

6. The apparatus of claim 2 wherein said centrifugal pump includes a fuel discharge orifice member formed from a synthetic jewel material.

7. The apparatus of claim 6 wherein said orifice member is formed from a synthetic ruby material.

8. The apparatus of claim 2 further comprising fuel injection means for selectively varying said fuel-air ratio, said fuel injection means including a fuel injection tube extending into said body, said tube having at its discharge end a discharge orifice formed from a synthetic jewel material.

9. The apparatus of claim 8 wherein said discharge orifice is formed from a synthetic ruby material.

10. The apparatus of claim 2 wherein:

said support means include an upper support member having bearing means therein which rotatably carry an upper end portion of said turbine rotor;

said carburetor apparatus has an internal passage extending downwardly into said turbine rotor, said bearing means being interposed between said internal passage and the interior of said air flow passage; and said carburetor apparatus further comprises means associated with said rotor for impeding fuel outflow through said bearing means from said internal passage extending downwardly into said turbine rotor.

11. The apparatus of claim 10 wherein said upper support member has a generally annular, downwardly extending end portion circumscribing said bearing means, and wherein said means for impeding fuel outflow include means for defining a restrictive passage circumscribing said downwardly extending end portion of said upper support member.

12. The apparatus of claim 11 wherein said means for defining a restrictive passage comprise a ring member having a lower end portion carried by said turbine rotor, and an upper end portion circumscribing said downwardly extending end portion of said upper support member.

13. The apparatus of claim 2 wherein said rotor has an upper end, and wherein said apparatus further comprises a central fuel supply tube extending axially downwardly through said upper rotor end, means defining an annular passage circumscribing said fuel supply tube within said rotor, and means for impeding fuel flow upwardly through said annular passage.

14. The apparatus of claim 13 wherein said flow-impeding means include a lower end portion of said fuel supply tube, said lower end portion being radially enlarged relative to the balance of said fuel supply tube within said annular passage.

15. The apparatus of claim 13 wherein said flow-impeding means include an annular teflon element press-fitted into said annular passage and slidably engaging said fuel supply tube.

16. The apparatus of claim 15 wherein said teflon element is positioned adjacent said upper rotor end.

17. The apparatus of claim 2 further comprising laterally disposed orifice means positioned in said passageway means for metering fuel flow therethrough, and wherein said passageway means have a portion which extends vertically during operation of said apparatus and communicates with the upstream side of said orifice means, said apparatus further comprising check valve means for preventing downward fuel flow through said vertically extending portion of said passageway means.

18. The apparatus of claim 17 wherein said check valve means include a ball movably received in said vertically extending passageway means portion, and a pin member extending downwardly through said vertically extending passageway means portion and positioned to limit the upward movement of said ball.

19. A rotor-type carburetor comprising:

a hollow cylindrical body axially insertable in a vertically extending air induction pipe of an internal combustion engine, said body being defined by releasably interconnectable upper and lower sections and having an axially extending interior air flow passage for flowing ingested air to the engine, said lower body section having axially centrally supported bearing means carried thereby, said upper body section having secured thereto, for movement therewith, a downwardly extending, axially central fuel supply tube adapted to receive fuel from a source thereof, said fuel supply tube having an open lower end positioned below the level of fuel in said source thereof;

bladed turbine rotor means coaxially circumscribing said fuel supply tube within said air flow passage and supported by said bearing means to be rotationally driven by ingested air downwardly traversing said air flow passage, the bladed portion of said turbine rotor means having an upper end and a lower end;

passageway means formed in said turbine rotor means for defining a centrifugal pump for drawing fuel from said fuel supply tube, and discharging a fine fuel mist for mixture with ingested air traversing said air flow passage, in response to rotation of said turbine rotor means, said passageway means including:

an inlet portion having an inlet end adapted to receive fuel from said fuel supply tube and an outlet end positioned above the level of fuel in said source thereof, a discharge portion having an inlet end communicating with said outlet end of said inlet portion, and an outlet end positioned below said lower end of said bladed portion of said turbine rotor means, and orifice means, positioned in said outlet end of said inlet portion of said passageway means, for precisely metering the flow of fuel through said carburetor.

20. The carburetor of claim 19 wherein:

said upper and lower body sections are telescopingly engageable plastic material, and said spray ring is of a metal material.

21. The carburetor of claim 19 further comprising:

means for capturing and storing fuel centrifugally discharged from said turbine rotor means, but not swept away by air flowing past and turning said turbine rotor means, to prevent the discharged fuel from being delivered to the engine.

22. The carburetor of claim 19 wherein:

said orifice means are formed from a synthetic jewel material.

23. The carburetor of claim 22 wherein:

said synthetic jewel material is a synthetic ruby material.

24. The carburetor of claim 19 further comprising:

check valve means, interposed in said inlet portion of said passageway means, for preventing a reverse flow of fuel through said carburetor.

25. The carburetor of claim 24 wherein:

said inlet portion of said passageway means has a generally vertically extending section with shoulder means formed therein, and said check valve means include a ball member seatable on said shoulder means and movable upwardly therefrom, and stop means for limiting the upward movement of said ball member.

26. The carburetor of claim 19 wherein:

said turbine rotor means have a cylindrical body section with a lower end, and said carburetor further comprises a spray ring press-fitted onto said lower end of said body section of said turbine rotor means and defining said outlet end of said discharge portion of said passageway means.

27. The carburetor of claim 26 wherein:

said body section of said turbine rotor means is of a

28. The carburetor of claim 19 further comprising:

adjustment means for selectively changing the fuel-air ratio of said carburetor by altering the velocity of a given mass flow of ingested air traversing said air flow passage.

29. The carburetor of claim 28 wherein:

said adjustment means include means for selectively altering the cross-sectional area of said air flow passage.

30. The carburetor of claim 29 wherein:

said means for selectively altering the cross-sectional area of said air flow passage include a plurality of differently configured insert members alternatively insertable into the interior of said air flow passage.

31. The carburetor of claim 29 wherein:

said means for selectively altering the cross-sectional area of said air flow passage include an adjustment member positionable within said air flow passage, and means for selectively moving said adjustment member axially with respect to said air flow passage.

32. The carburetor of claim 31 wherein:

said means for selectively moving said adjustment member include thread means for securing said adjustment member within the interior of said air flow passage.

33. The carburetor of claim 31 wherein:

said means for selectively moving said adjustment member include a pin member secured to said adjustment member, and an axially ramped surface formed on said body and operatively engaging said pin member.

34. A rotor-type carburetor comprising:

a hollow cylindrical body axially insertable in a vertically extending air induction pipe of an internal combustion engine, said body having an upper section, a lower section, and an axially extending interior air flow passage for flowing ingested air to the engine;

a downwardly extending, axially central fuel supply tube secured to said upper body section for movement therewith and adapted to receive fuel from a source thereof;

first bearing means axially centrally carried by said upper body section;

second bearing means axially centrally carried by said lower body section;

cooperating means on said upper and lower body sections for releasably interconnecting them to define said body and to bring said first and second bearing means into an axially spaced and aligned relationship;

bladed turbine rotor means coaxially circumscribing said fuel supply tube within said air flow passage and supported by said first and second bearing means for driven rotation by ingested air downwardly traversing said air flow passage;

passageway means formed in said turbine rotor means for defining a centrifugal pump operative to draw fuel from said fuel supply tube, and discharge a fine fuel mist for mixture with ingested air traversing said air flow passage, in response to rotation of said turbine rotor means; and orifice means for precisely metering the flow of fuel through said carburetor.

35. The carburetor of claim 34 wherein:

said cooperating means include telescopingly engageable axial portions of said upper and lower body sections.

36. The carburetor of claim 34 further comprising:

check valve means, interposed in said passageway means, for preventing a reverse flow of fuel through said carburetor.

37. The carburetor of claim 34 further comprising:

means for capturing and storing fuel centrifugally discharged from said turbine rotor means that is not swept away by ingested air flowing across and rotationally driving said turbine rotor means.

38. The carburetor of claim 34 further comprising:

adjustment means for selectively changing the fuel-air ratio of said carburetor by altering the velocity of a given mass flow of ingested air traversing said air flow passage.

39. The carburetor of claim 38 wherein:

said adjustment means include means for selectively altering the cross-sectional area of said air flow passage.

40. The carburetor of claim 34 wherein:

said fuel supply tube has an open lower end positioned below the level of fuel in said source thereof, the balded portion of said turbine rotor means has an upper end and a lower end, said passageway means include an inlet portion having an inlet end adapted to receive fuel from said fuel supply tube and an outlet end positioned above the level of fuel in said source thereof, and a discharge portion having an inlet end communicating with said outlet end of said inlet portion, and an outlet end positioned below said lower end of said bladed portion of said turbine rotor means, and said orifice means are positioned in said outlet end of said inlet portion of said passageway means.

41. The carburetor of claim 40 wherein:

said orifice means are formed from a synthetic jewel material.

42. The carburetor of claim 41 wherein:

said synthetic jewel material is a synthetic ruby material.

43. A rotor-type carburetor comprising:

first and second hollow cylindrical members respectively carrying axially centrally disposed first and second bearing meams and being releasably interengageable to define a hollow cylindrical body portion of said carburetor and to position said first and second bearing means in an axially spaced and aligned relationship, said body portion having an axially extending interior air flow passage for flowing ingested air to an engine;

centrally disposed, axially extending fuel supply tube means, positioned within said air flow passage, for receiving fuel from a source thereof;

bladed turbine rotor means coaxially circumscribing said fuel supply tube means within said air flow passage and supported by and between said first and second bearing means to be rotationally driven by ingested air traversing said air flow passage, said bladed turbine rotor means, in response to rotation thereof, being operative to draw fuel from said fuel supply tube means and centrifugally discharge the fuel for mixture with the ingested air; and orifice means, operatively associated with said bladed turbine rotor means, for precisely metering the flow of fuel through said carburetor.

* * * * *

UNITED STATES PATENT AND TRADEMARK OFFICE

CERTIFICATE OF CORRECTION

PATENT NO. : 4,869,850

DATED : September 26, 1989

INVENTOR(S) : Elbert M. Hubbard and Rudolf Diener

It is certified that error appears in the above-identified patent and that said Letters Patent is hereby corrected as shown below:

Col. 1, line 25, delete "as a", second occurrence.

Col. 1, line 41, after "spray", insert --ring--.

Col. 6, line 53, after "70", insert --and--.

Col. 13, line 35, "syphon-breaking" should be --siphon-breaking--.

Col. 15, line 18, after "engageable", insert --.-- and delete "plastic material, and said spray ring is of a metal material."

Col. 15, line 53, after "of a", insert --plastic material, and said spray ring is of a metal material.--

Signed and Sealed this

Twenty-first Day of August, 1990

*Attest:*

*Attesting Officer*

HARRY F. MANBECK, JR.

*Commissioner of Patents and Trademarks*